US005092764A

United States Patent [19]

McDonough et al.

[11] Patent Number: 5,092,764

[45] Date of Patent: Mar. 3, 1992

[54] SELECTIVELY ACTUATABLE LIGHTER WITH LOCKING VALVE CAP

[75] Inventors: James M. McDonough, Guilford; Floyd B. Fairbanks, Naugatuck, both of Conn.

[73] Assignee: Bic Corporation, Milford, Conn.

[21] Appl. No.: 551,709

[22] Filed: Jul. 11, 1990

[51] Int. Cl.[5] ..... F23D 11/36

[52] U.S. Cl. ..... 431/277; 431/153; 431/255; 222/153

[58] Field of Search ..... 431/153, 255, 277, 344; 257/95, 99, 101, 102, 110, 111; 222/153, 402.11, 384, 509

[56] References Cited

U.S. PATENT DOCUMENTS

| | | | |
|---|---|---|---|
| 1,895,032 | 1/1933 | Fisher . | |
| 2,520,328 | 8/1950 | Nissen | 67/7.1 |
| 2,637,577 | 5/1953 | Wiessner | 292/122 |
| 2,727,376 | 12/1955 | Felt | 67/7.1 |
| 2,806,520 | 9/1957 | Adams | 158/73 |
| 3,169,672 | 2/1965 | Soffer et al. | 222/153 |
| 3,194,435 | 7/1965 | Burchett | 222/3 |
| 3,213,647 | 10/1965 | Sakamoto | 67/7.1 |
| 3,267,988 | 8/1966 | Schott | 158/73 |
| 3,450,143 | 6/1969 | Tamarin | 137/38 |
| 3,547,566 | 12/1970 | Tamarin | 431/88 |
| 3,601,165 | 8/1971 | Obata | 141/302 |
| 3,612,736 | 10/1971 | Steuernagel et al. | 431/130 |
| 3,723,048 | 3/1973 | Russell | 431/151 |
| 3,744,953 | 7/1973 | Herr | 431/13 |
| 3,752,637 | 8/1973 | Norman et al. | 431/274 |
| 3,756,766 | 9/1973 | Green | 431/254 |
| 3,816,056 | 6/1974 | Brown | 431/253 |
| 3,817,693 | 6/1974 | Sebens et al. | 431/153 |
| 3,828,982 | 8/1974 | Steigerwald | 222/153 |
| 3,894,665 | 7/1975 | Swenson | 222/402.11 |
| 3,898,031 | 8/1975 | Rusakowicz | 431/130 |
| 3,899,285 | 8/1975 | Christmas | 431/152 |
| 3,899,286 | 8/1975 | Lockwood et al. | 431/321 |
| 3,904,088 | 9/1975 | Milbourne, Sr. | 251/111 X |
| 3,910,752 | 10/1975 | Holl | 431/273 |
| 3,938,943 | 2/1976 | Malamoud | 431/150 |
| 3,940,023 | 2/1976 | Umstead | 222/153 |
| 3,955,585 | 5/1976 | Fox | 131/186 |
| 3,963,413 | 6/1976 | Lockwood et al. | 431/276 |
| 3,966,392 | 6/1976 | Lockwood | 431/344 |
| 3,985,493 | 10/1976 | Neyret | 431/150 |

(List continued on next page.)

FOREIGN PATENT DOCUMENTS

| | | | |
|---|---|---|---|
| 296281 | 12/1988 | European Pat. Off. . | |
| 2210552 | 9/1973 | Fed. Rep. of Germany | 431/344 |
| 2198092 | 3/1974 | France . | |
| 2220047 | 9/1974 | France . | |
| 2633702 | 1/1990 | France . | |
| 2210682 | 6/1989 | United Kingdom | 431/344 |

*Primary Examiner*—Carl D. Price
*Attorney, Agent, or Firm*—Pennie & Edmonds

[57] ABSTRACT

An improved selectively actuatable child resistant lighter device is disclosed which includes a body defining reservoir for containing a combustible gaseous medium such as butane, and having a valve arranged to be selectively actuated between a normally closed position and an open position which permits the exit of the gaseous medium. A locking mechanism normally prevents actuation of the valve to the open position. Such child resistant lighter device embodies a resiliently releasable locking latch which prevents movement of a fuel nozzle from a first, or fuel cutoff, position to a second, or fuel flow, position. The locking latch is selectively movable to an unlocked position in which depression of a valve actuator causes the fuel nozzle to move from the fuel cutoff position to the fuel flow position, so that the gaseous medium may be released and ignited by the sparks. The locking latch is resiliently structured and mounted such that once a flame is produced and the valve actuator is released, the locking latch returns to its closed or locked position to prevent actuation of the valve to the open position. To "re-use" the lighter, the locking latch must again be moved to the unlocked position so that the fuel nozzle may expel fuel upon depression of the valve actuator. Such mechanism is difficult for a young child to light, but is capable of actuation by adults.

62 Claims, 6 Drawing Sheets

U.S. PATENT DOCUMENTS

| | | | |
|---|---|---|---|
| 4,003,694 | 1/1977 | Lowell | 431/344 |
| 4,008,992 | 2/1977 | Johnsson | 431/344 |
| 4,028,043 | 6/1977 | Neyret | 431/144 |
| 4,036,579 | 7/1977 | Marynissen | 431/131 |
| 4,049,370 | 9/1977 | Neyret | 431/144 |
| 4,102,633 | 7/1978 | Zellwegger et al. | 431/152 |
| 4,111,638 | 9/1978 | Ostberg | 431/13 |
| 4,150,940 | 4/1979 | Heller et al. | 431/130 |
| 4,181,490 | 1/1980 | Nitta | 431/129 |
| 4,190,412 | 2/1980 | Nitta | 431/151 |
| 4,324,351 | 4/1982 | Meshberg | 222/402.11 |
| 4,403,945 | 9/1983 | Leitgib | 431/150 |
| 4,413,638 | 11/1983 | Le | 131/174 |
| 4,416,612 | 11/1983 | Tabata | 431/131 |
| 4,432,542 | 2/1984 | Poynter | 272/27 |
| 4,457,699 | 7/1984 | Hattori | 431/344 |
| 4,487,570 | 12/1984 | Lowenthal | 431/130 |
| 4,522,583 | 6/1985 | Kraser | 431/128 |
| 4,717,335 | 1/1988 | Loveless | 431/277 |
| 4,758,152 | 7/1988 | Kordecki | 431/153 |
| 4,773,849 | 9/1988 | Schachter | 431/344 |
| 4,784,601 | 11/1988 | Nitta | 431/153 |
| 4,784,602 | 11/1988 | Nitta | 431/153 |
| 4,786,248 | 11/1988 | Nitta | 431/255 |
| 4,799,877 | 1/1989 | Bisbee | 431/153 |
| 4,810,187 | 3/1989 | Nitta | 431/255 |
| 4,822,276 | 4/1989 | Bisbee | 431/153 |
| 4,830,603 | 5/1989 | Cirani | 431/277 |
| 4,832,596 | 5/1989 | Morris, Sr. | 431/153 |
| 4,844,244 | 7/1989 | Mawby | 206/88 |
| 4,844,254 | 7/1989 | Jang | 206/236 |
| 4,844,667 | 7/1989 | Lin | 431/151 |
| 4,850,854 | 7/1989 | Buck | 431/143 |
| 4,854,859 | 8/1989 | Lin | 431/344 |
| 4,859,172 | 8/1989 | Nitta | 431/153 |
| 4,859,174 | 8/1989 | Zellweger et al. | 431/255 |
| 4,869,663 | 9/1989 | Fremund | 431/153 |
| 4,889,482 | 12/1989 | Schachter | 431/344 |
| 4,904,180 | 2/1990 | Nitta | 431/153 |
| 4,921,420 | 5/1990 | Johnston | 431/153 |

FIG. 14
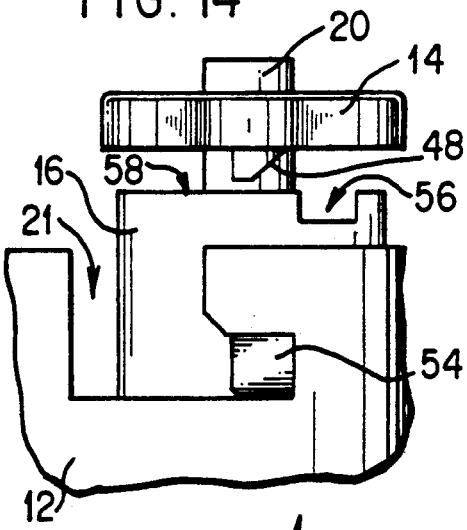
FIG. 15
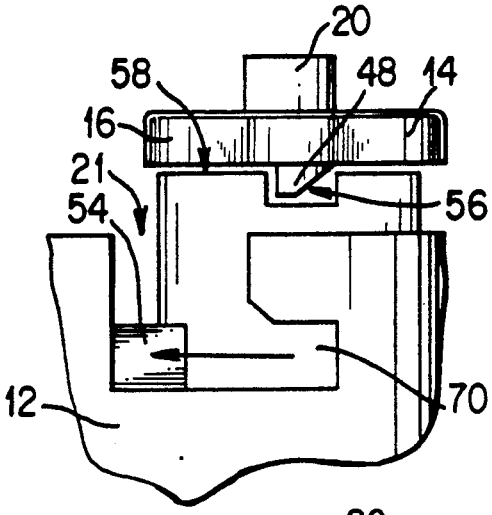
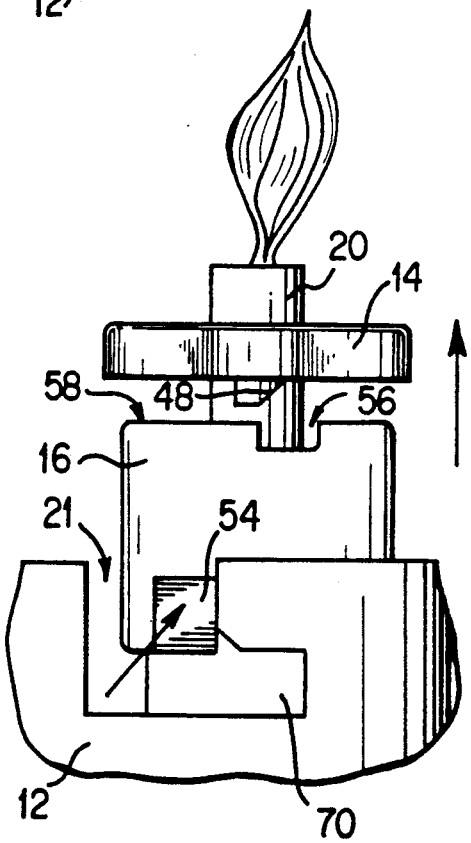
FIG. 17
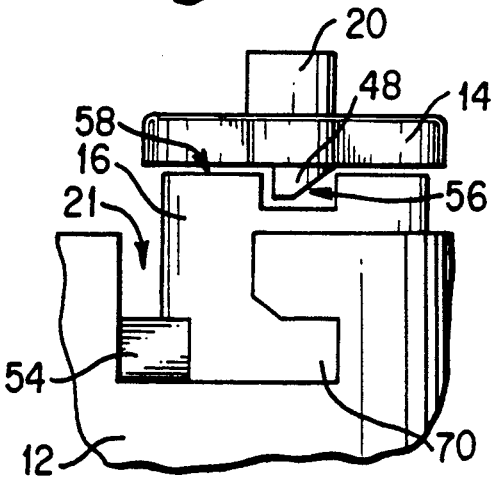
FIG. 16
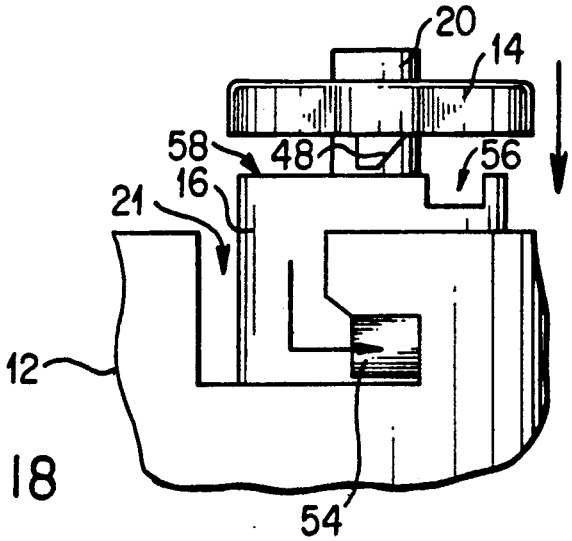
FIG. 18

SELECTIVELY ACTUATABLE LIGHTER WITH LOCKING VALVE CAP

BACKGROUND OF THE INVENTION

1. Cross-Reference to Related Applications

This is related to U.S. Pat. applications Ser. No. 07/239,734 filed on Sept. 2,1988, entitled "Selectively Actuatable Lighter" now U.S. Pat. No. 5,002,482, and Ser. No. 07/455,059 filed on Dec. 22, 1989, entitled "Bidirectional Selectively Actuatable Lighter", each of which is incorporated herein by reference.

2. Technical Field

This invention relates generally to lighters which consume fuel such as, for example, butane which is stored in a reservoir in a liquid state, then passed through a valve means where it becomes gaseous, and finally ignited by a spark or other similar means. More particularly, the invention relates to a disposable butane cigarette lighter having a locking mechanism which prevents lifting of a valve, or fuel, nozzle and in turn prevents the fuel nozzle from expelling the fuel thereby rendering operation of the lighter by young children difficult. The locking mechanism of the lighter may be deactivated by moving a locking latch to a non-interfering position which enables lifting of the valve, or fuel, nozzle thus increasing the user friendliness of the lighter to the intended users.

3. Description of the Prior Art

Various prior art lighters, some of them incorporating safety or locking features, are known. Such features are generally provided to reduce the risk of injury to an operator or bystanders. Some of these features relate to mechanisms which prevent ignition of a fuel source unless the lighter is properly oriented, mechanisms which control a fuel source supply valve and tamper protection arrangements.

More recently, attention has been directed toward preventing ready actuation of such lighters by persons normally not able to appreciate the potential danger of the flame. Such danger includes the potential to burn the individual directly or to burn surrounding areas or items, thus creating the possibility of spreading to a fully developed fire. Individuals normally contemplated in these efforts are small children, mostly in the age category of five years or younger.

For example, U.S. Pat. No. 4,830,603 to Cirami, not regarded as prior art, relates to a cigarette lighter in which a locking mechanism is provided partially under a valve-actuating pushbutton and extends into a compartment appended to but distinct from a fuel compartment. The locking mechanism relocks itself after each depression of the pushbutton. In particular, one end of a stiffly flexible, spring steel wire is held firmly in place in the compartment. Another end of the spring steel wire forms a probe extending into a channel provided in the underside of the pushbutton. The spring steel wire, in a locked configuration, prevents depression of the pushbutton by engaging a low ceiling on the underside of the pushbutton. A portion of the spring steel wire in the form of a loop extending outward from the lighter is accessible by an operator and may be suitably moved by the operator thereby causing the probe to move within the channel in the underside of the pushbutton.

U.S. Pat. No. 4,832,596 to Morris, Sr., not regarded as prior art, relates to a cigarette lighter having a stop member slidably mounted thereon for releasably engaging a gas valve actuating lever. In particular, a spring biased stop member is slidably mounted on a top portion of a conventional portable disposable cigarette lighter. The stop member is biased so as to place one of its ends under the lighter's gas valve actuating lever so as to prevent movement of the lever in a direction which may open the gas valve. The lever may be actuated once the stop member is pushed in a direction opposite to the biasing force of the spring so as to slide the end which is under the lighter's gas valve outward.

U.S. Pat. No. 4,717,335 to Loveless relates to a cigarette lighter in which rotation of a spark-producing wheel is limited. In particular, the spark-producing wheel may be rotated in one direction to deliver a spark toward a nozzle through which gaseous fuel is passed, thereby operating the lighter and causing fuel to ignite. Rotation of the spark-producing wheel in the other direction may deliver a spark away from the nozzle. The spark-producing wheel has a pin-shaped structure attached thereto which serves to limit the rotation of the wheel to under 360 by contacting the housing structure. Thus, whether a spark indeed is produced depends upon the direction of attempted rotation and the position of the pin-shaped structure relative to the housing structure. In theory, once the lighter is operated and the fuel ignited, and the pin-shaped structure has traversed its entire path of travel, subsequent operation of the lighter is impeded since the pin-shaped structure comes into contact with the housing, preventing a spark from occurring in the vicinity of the fuel nozzle.

U.S. Pat. Nos. 4,028,043 and 4,049,370 each to Neyret relate to presale tamper protection mechanisms which partially surround a spark-producing wheel, fuel nozzle or depressable valve actuation member of a lighter. These presale tamper protection mechanisms are attached to the lighter housing by frangible webs and are removed by a purchaser after sale of the lighter to expose the spark-producing wheel, fuel nozzle and depressable valve actuation member. However, such a presale tamper protection mechanism is of limited value once initially removed by a purchaser.

U.S. Pat. Nos. 3,547,566 to Tamarin and U.S. Pat. No. 3,899,286 to Lockwood et al. relate to lighters having orientation sensing mechanisms which hinder or prevent actuation of the lighter in an inverted position. Unfortunately such mechanisms may not provide a sufficient degree of safety to young children who tamper with the lighter since they merely hinder operation in prescribed orientations.

Many safety or locking mechanisms are unnecessarily complicated, present difficulty in their manufacture, and exhibit a high likelihood of mechanical failure during use. Another disadvantage found in some devices is that the particular construction employed limits the shape and size of the lighter housing due to the requirement that the housing be large enough to accommodate the safety mechanism(s). Further disadvantages relate to the relative ease which some safety mechanisms may be defeated and to the reliability of the safety mechanisms. For example, some safety mechanisms may be overridden or removed with relative ease. Additionally, some devices include inconveniently shaped levers or knobs which need to be actuated by the user in order to operate the lighter. Furthermore, some of these devices require repositioning of the lighter in an operator's hand after actuation of the safety mechanism and before the lighter is operated to produce a flame. A further disadvantage of some devices relates to the apparency of a means as a safety device whose function it is to prevent lighter actuation. In other words, the obviousness of a safety means may lead to increased efforts to circumvent the safety means.

Although it is known to prevent or hinder presale actuation of a depressable valve actuation member or actuation of a lighter in a specified orientation, none of the above-described lighters provides an efficiently manufacturable, relatively small, reliable mechanism for directly preventing lifting of the fuel nozzle and in turn preventing the fuel nozzle from expelling fuel.

Although current efforts as described herein may sometimes be referred to as "child-proof lighters", "child-resistant lighters" or the like, it should be made clear that such developments are actually directed toward minimizing ready flame production on a flame producing lighter by persons normally considered incapable of appreciating the potential danger of a lighter flame.

Consistent with such efforts is the recognition that to develop a "child-proof" lighter per se, would not be viable. At best it can be reasonably sought to create a lighter which is "child-resistant", but how "child-resistant" a lighter will be will depend upon related factors and circumstances. For example, it is known that lighters are specifically designed to produce a flame. Accordingly, if the lighter were to come into the possession of a person incapable of appreciating the potential danger of the flame a potentially dangerous situation will prevail. This situation would be independent of the operating condition of the lighter and would prevail even if the lighter is in perfect working order. Further, in many instances lighters contain clear written warnings prominently displayed on their surface and, without proper supervision, a young child who gains possession of the lighter can cause harm by the fact that the warning will not be appreciated since it cannot be read and/or understood by the child. Accordingly, "child-resistant" efforts are best directed toward protecting the child from its own acts should the child come into possession of a lighter with or without the parents' knowledge or consent. The potential danger would prevail even if the lighter is a properly functioning lighter and has a clear warning displayed thereon advising the user to keep the lighter out of the reach of children.

Nevertheless, any such "child-resistant" lighter will have its limitations with respect to young children, and no such lighter should provide parents or adults with a false sense of security so that they may become less cautious in their handling of the lighter or permit ready access to the lighter by young children. Further, such lighters should not be made so difficult to light as to cause adults to use alternative forms of lighting, i.e., matches, which are generally considered to be potentially more dangerous. At best, the lighter should provide a young child with sufficient deterrent features as to prevent the child from readily producing a flame on the lighter or to deter the child from readily producing a flame at least for a time sufficient to permit the normally expected intervention of adult supervision.

The present invention is directed toward a flame producing lighter which is selectively actuatable in such a manner as to provide a substantial degree of difficulty for young children—mostly five years or younger—to actuate the lighter and produce a flame, while being user friendly and capable of actuation by adults.

SUMMARY OF THE INVENTION

This invention relates to a child resistant selectively actuatable flame producing lighter having a locking mechanism which is normally in a locked position and is movable to an unlocked position in which the lighter may be operated. Typically, the lighter includes a valve and a depressable valve actuator for controlling the flow of fuel through a fuel, or valve, nozzle. Lifting the fuel nozzle from a first position to a second position opens the valve and permits the flow of fuel through the fuel nozzle. The term "lifting" as used herein includes removing forces which prevent the nozzle from being lifted thereby enabling the nozzle to be lifted, as well as generally moving the nozzle from a first position to a second position. Advantageously, a locking mechanism is included and is movable from a default or locked position to an unlocked position. In the locked position, the locking mechanism prevents, even if the valve actuator is depressed, lifting of the fuel nozzle from the first position to the second position thereby preventing the flow of fuel. In the unlocked position, the locking mechanism permits lifting of the fuel nozzle upon depression of the valve actuator thereby permitting fuel to flow.

In particular, the invention relates to a lighter which comprises a housing defining reservoir for containing a combustible gaseous medium under pressure, valve or fuel nozzle means for expelling the gaseous medium, valve means arranged for selective actuation between a normally closed position in which the fuel nozzle means is in a first position preventing exit of the gaseous medium from the reservoir, and an open position in which the fuel nozzle means is in a second position permitting exit of gaseous medium from the reservoir through the valve means, means for selectively producing sparks at a location proximate the fuel nozzle means thereby selectively causing ignition of the gaseous medium, means normally positioned for preventing movement of the fuel nozzle means from the first position to the second position, the nozzle movement prevention means being movable out of the normal position only by application of an external force, depressable valve actuator means for providing a first biasing force to the nozzle movement prevention means, the force tending to maintain the fuel nozzle means in the first position, and means for selectively moving the nozzle movement prevention means to a position whereby actuation of the valve means to the open position is permitted upon depression of the valve actuator means thereby selectively permitting exit of the combustible gaseous medium from the valve means and ignition of the gaseous medium by sparks produced by the spark-producing means. The lighter preferably also includes spring means for biasing the fuel nozzle means from the first position to the second position wherein the valve means is actuated to the open position by removing the first biasing force and a second biasing force supplied by the nozzle movement prevention means thereby enabling the spring means to force the fuel nozzle means from the first position to the second position. The spring means is preferably an elastomeric ring.

In a preferred embodiment, the means for preventing movement of the fuel nozzle means from the first position to the second position comprises a locking latch rotatable from a normally locked position to an unlocked position. In particular, the movement of the locking latch from the normally locked position to the unlocked position is resiliently provided. Additionally, the resilient movement of the locking latch causes the locking latch to automatically return to its locked position and the fuel nozzle means to its first position when the depressable valve actuator means is released, thus preventing the valve means from opening.

In one embodiment, the locking latch is movable from a normally locked position to any one of a plurality of unlocked positions. Preferably, the movement of the locking latch is resiliently provided, thereby automatically returning the locking latch to its locked position from any of its unlocked positions.

In this illustrative embodiment, the locking latch is movable in a cross-wise direction from its locked position to its unlocked position whereupon depression of the valve actuator means causes the gaseous medium to exit the fuel nozzle means and whereupon release of the valve actuator means causes the locking latch to move back to its locked position. The lighter further comprises means to retain the locking latch in the unlocked position at least until the valve actuator means is depressed. The retention means may comprise a suitably located tab on the valve actuator means and a suitably located notch in the locking latch for engagement with the tab when the locking latch is in the unlocked position.

The valve means of this lighter comprises a valve seal attached to an end of the fuel nozzle means and a valve seat adapted for fuel flow therethrough and for engagement with the valve seal, the valve seal engaging the valve seat when the fuel nozzle means is in the first position thereby preventing fuel flow, and the valve seal not engaging the valve seat when the fuel nozzle means is in the second position.

The means for selectively producing sparks comprises flint material and a rotatable spark-producing wheel having a toothed surface positioned and arranged to selectively frictionally contact the flint material. Alternatively, the means for selectively producing sparks comprises electric spark-producing means such as piezoelectric spark-producing means.

A fuel cutoff locking mechanism is disclosed for use in combination with a lighter comprising means for normally preventing actuation of a fuel supply, the means including a fuel nozzle normally in a first position which prevents flow of fuel and movable to a second position which permits flow of fuel, a depressable valve actuator which normally supplies a biasing force tending to keep the fuel nozzle in the first position and which, upon depression, removes the biasing force, and a locking latch normally positioned so as to maintain the fuel nozzle in the first position regardless of the position of the depressable valve actuator, wherein application of an external force to the locking latch moves the locking latch into a position in which depression of the valve actuator enables the fuel nozzle to move from the first position to the second position, wherein such selective actuation of the fuel supply and a corresponding production of sparks by spark-producing means ignites fuel from the fuel supply.

This fuel cutoff locking mechanism further comprises spring means to bias the fuel nozzle from the first position into the second position, wherein a force exerted by the spring means is less than the biasing force exerted by the depressable valve actuator. The spring means is preferably an elastomeric ring. The actuation prevention means comprises a valve seal attached to an end of the fuel nozzle and a valve seat adapted for fuel flow therethrough and for engagement with the valve seal, the valve seal engaging the valve seat when the fuel nozzle is in the first position thereby preventing fuel flow, and the valve seal not engaging the valve seat when the fuel nozzle is in the second position. Advantageously, the movement of the locking latch is resiliently provided so as to automatically return the locking latch to its normal position when the depressable valve actuator is released, thus preventing flow of fuel.

This fuel cutoff locking mechanism further comprises means to retain the locking latch in the position in which depression of the valve actuator enables movement of the fuel nozzle at least until the valve actuator is depressed. For example, such retention means may comprise a suitably located tab on the valve actuator and a suitably located notch in the locking latch for engagement with the tab when the locking latch is in the position in which depression of the valve actuator enables movement of the fuel nozzle. Cross-wise movement of the locking latch places the locking latch in the position in which depression of the valve actuator enables movement of the fuel nozzle.

A lighter is also disclosed comprising a housing, fuel supply means for supplying fuel to be ignited, ignition means for igniting fuel, valve means including fuel nozzle means for selectively permitting flow of the fuel, the fuel nozzle means normally in a first position which prevents flow of the fuel, and being biased by a first biasing means towards a second position which permits flow of the fuel, the first biasing means supplying a first biasing force, valve actuator means for supplying a second biasing force tending to keep the fuel nozzle means in the first position, the second biasing force being greater than the first biasing force, and means for selectively unlocking the lighter from a normally locked configuration in which the fuel nozzle means is maintained in the first position by the selectively unlocking means, the selectively unlocking means being positionable into an unlocked position, and the selectively unlocking means being operable by a user's finger, wherein positioning the selectively unlocking means into the unlocked position enables removal of the second biasing force by depressing the valve actuator means thereby permitting the first biasing means to move the fuel nozzle means towards the second position thereby permitting flow of the fuel.

In this lighter, the means for selectively unlocking the lighter comprises a valve actuator which, when in a first position, normally supplies the second biasing force, the valve actuator being depressable so as to remove the second biasing force, and a locking latch which normally confines the fuel nozzle means to the fuel nozzle means first position regardless whether the depressable valve actuator is depressed, wherein selective application of a third biasing force by the operator to the locking latch causes, upon the depression of the valve actuator, the fuel nozzle means to move to the second position and fuel to flow. An elastomeric spring means may be employed to supply the first biasing force. The third biasing force is applied in a lateral direction and is resiliently provided so as to automatically return the locking latch to its normal position and the fuel nozzle means to its first position when the valve actuator is released, thus preventing the valve means from opening.

An improved flame producing lighter is also disclosed of the type having a housing, a fuel supply, valve means for selectively supplying fuel from the fuel supply to a fuel nozzle and spark-producing means for producing sparks, the fuel nozzle being movable so as to selectively actuate the valve means, wherein the improvement comprises means for selectively permitting actuation of the valve means thereby selectively permitting exit of fuel from the fuel supply through the valve means and ignition of the fuel by sparks produced by the spark-producing means, the means for selectively permitting actuation including pivotally mounted actuator means and a locking latch normally in a locked position in which the locking latch prevents actuation of the valve means by preventing movement of the fuel nozzle, the locking latch being positionable into an unlocked position in which the locking latch permits actuation of the valve means by permitting movement of the fuel nozzle upon depression of the actuator means.

This improved flame producing lighter preferably includes means for retaining the locking latch in the unlocked position at least until the actuator means is depressed. For example, such means may comprise a suitably located tab on the actuator means and a suitably located notch in the locking latch for engagement with the tab when the locking latch is in the unlocked position. The movement of the locking latch from the locked position to the unlocked position is resiliently provided so as to automatically return the locking latch to its locked position when the actuator means is released, thereby preventing flow of fuel.

The invention also relates to a flame developing lighter comprising a housing, fuel supply means for supplying fuel to be ignited, ignition means for igniting fuel, valve means for selectively permitting flow of the fuel, a fuel nozzle for expelling fuel and being operatively associated with the valve means, and control means for preventing the combination of production of fuel flow and spark generation so as to prevent production of a flame and for permitting substantially simultaneous production of fuel flow and spark generation to produce a flame.

The control means of this lighter comprises a valve actuator which normally prevents escape of the fuel from the fuel supply when in a first position by preventing lifting of the fuel nozzle and is depressable to a second position which does not prevent lifting of the fuel nozzle, a locking latch which is normally in a locked position preventing lifting of the fuel nozzle and which is movable to an unlocked position which causes the fuel nozzle to be lifted upon depression of the valve actuator thereby causing fuel to flow, and elastomeric spring means for supplying a biasing force tending to lift the fuel nozzle, wherein selective application of a biasing force by the operator to the locking latch permits the locking latch to move from the locked position to the unlocked position.

Advantageously, the movement of the locking latch to the unlocked position is resiliently provided so as to automatically return the locking latch to its locked position when the valve actuator is released, thus preventing fuel flow. Cross-wise movement of the locking latch places the locking latch in the unlocked position. The locking latch is resiliently maintained in the unlocked position by pressure exerted by the valve actuator on the locking latch.

A flame producing lighter resistant to unauthorized use and normally maintained in a locked configuration is also disclosed. This lighter comprises a housing, fuel supply means for supplying fuel to be ignited, a fuel nozzle for expelling the fuel, elastomeric biasing means for applying a first biasing force biasing the fuel nozzle from a first position to a second position, ignition means for igniting the fuel, valve means for controlling the flow of the fuel, the valve means preventing fuel from flowing through the fuel nozzle when the fuel nozzle is in the first position and permitting fuel to flow through the fuel nozzle when the fuel nozzle is in the second position, a valve actuator which normally prevents escape of the fuel when in a first position and is depressable to a second position which removes a second biasing force, the second biasing force tending to maintain the fuel nozzle in the first position, and a locking latch which is normally in a locked position and maintains the fuel nozzle in the first position, the locking latch being positionable into an unlocked position in which the locking latch permits actuation of the valve means by permitting movement of the fuel nozzle from the first position to the second position upon depression of the depressable valve actuator, wherein lateral movement of the locking latch places the locking latch in the unlocked position, the unlocked position being resiliently maintained by pressure exerted by the valve actuator on the locking latch.

A flame producing lighter is also disclosed which comprises a housing defining reservoir for containing a combustible gaseous medium under pressure, a fuel nozzle for expelling fuel, valve means arranged for selective actuation between a normally closed position which prevents exit of the gaseous medium from the reservoir and in which the fuel nozzle is in a first position, and an open position which permits exit of gaseous medium from the reservoir through the valve means and in which the fuel nozzle is in a second position, means for selectively producing sparks at a location proximate the fuel nozzle thereby selectively causing ignition of the gaseous medium, means normally positioned for preventing actuation of the valve means to the open position by preventing movement of the nozzle from the first position to the second position, the valve actuation prevention means being movable out of the actuation prevention position only by application of an external user applied force, means for selectively moving the valve actuation prevention means from the actuation prevention position to the open position whereby actuation of the valve means to the open position is permitted thereby selectively permitting exit of the combustible gaseous medium from the fuel nozzle and ignition of the gaseous medium by sparks produced by the spark producing means, and means for retaining the valve actuation prevention means in the valve actuation prevention position at least until the force is applied thereto.

In this embodiment, the valve actuation prevention means is positioned around the fuel nozzle and is rotatable from the locked position to the unlocked position.

The lighter further comprises a biasing means for applying a biasing force biasing the fuel nozzle from the first position to the second position.

The invention also relates to a lighter having valve actuation prevention means movable between a first default position whereby actuation of the valve means to the open position is prevented, and an unlocked position whereby actuation of the valve means is permitted, the valve actuation prevention means being movable from the default position to the unlocked position only by application of an external user applied force.

The valve actuation prevention means may be positioned around the fuel nozzle and is rotatable from the default position to the unlocked position. In this embodiment, a biasing means applies a force which biases a fuel nozzle from a first position to a second position wherein the force supplied by the biasing means is less than a force supplied by a valve actuator means tending to keep the valve means in a closed position.

Another embodiment of the lighter includes means positioned around a portion of the fuel nozzle. This means is configured, dimensioned and adapted, when in a locked position, for preventing movement of the fuel nozzle from the first position to the second position regardless of the position of the valve actuation means, the prevention means being movable to an unlocked position in which depression of the valve actuation means moves the fuel nozzle from the first position to the second position thereby enabling fuel to flow, the prevention means returning automatically to the locked position after the valve means is moved to the open position and the valve actuation means released, the prevention means being movable from the locked position to the unlocked position only by the application of an external user applied force.

The invention also relates to a fuel cut-off locking mechanism for use in combination with a lighter which comprises valve means for controlling flow of fuel from a fuel supply including a fuel nozzle which is normally in a first position preventing flow of fuel therethrough and being movable to a second position permitting flow of fuel therethrough and a spring means for biasing the fuel nozzle from the first position to the second position, means for selectively permitting actuation of the fuel supply including a depressible valve actuator which upon depression removes a force biasing the fuel nozzle to the first position, and a locking latch which is normally in a locked position preventing movement of the fuel nozzle from the first position to the second position regardless whether the valve actuator is depressed, the locking latch being arranged such that lateral movement of the locking latch into an unlocked position permits, upon depression of the valve actuator, the spring means to move the fuel nozzle from the first position to the second position enabling fuel to flow, the locking latch being resiliently maintained in the unlocked position by force exerted by the valve actuator on the locking latch.

Advantageously, if the lighter is left unattended a young child or other such person will encounter difficulty in releasing any gaseous material to produce a flame due to the locking action of the locking latch and the effort required to move it into the unlocked position. Thus, in the event the lighter inadvertently comes into the possession of a young child, the child may be able to turn the spark-producing wheel but will, at best, only be able to produce sparks from the spark-producing wheel by rotating it against the flint. Gaseous material will not be released due to the action of the locking latch which directly prevents lifting of the fuel nozzle thereby preventing the valve from opening and expelling fuel.

Operation of the lighter requires a certain amount of dexterity and the application of concentrated forces as well as the application of a plurality of forces in multiple directions and in a specified sequence. Advantageously, these factors tend to render the lighter difficult to operate by young children.

Furthermore, the lighter of the present invention is a passive locking lighter. Advantageously, the lighter automatically returns to its locked configuration once the depressed valve actuator is released. Thus, the lighter is maintained in an at-rest or default configuration which is locked thereby preventing the production of a flame.

BRIEF DESCRIPTION OF THE DRAWINGS

These and other objects, features and advantages of the present invention will become more readily apparent from the following detailed description of the invention in which like elements are labelled similarly and in which:

FIG. 14 is a frontal view of the locking latch of the preferred embodiment of the child resistant lighter in its locked position thereby preventing lifting of the fuel nozzle;

FIGS. 15 and 16 are frontal views of the locking latch in an unlocked position which enables depression of the valve actuator and lifting of the fuel nozzle;

FIG. 17 is a frontal view of the locking latch in its unlocked position and the valve actuator depressed so as to permit lifting of the fuel nozzle and the flow of fuel; and FIG. 18 is a frontal view of the locking latch returned to its locked position, thereby shutting off the flow of fuel.

DETAILED DESCRIPTION OF THE PREFERRED EMBODIMENTS

Figure 1:
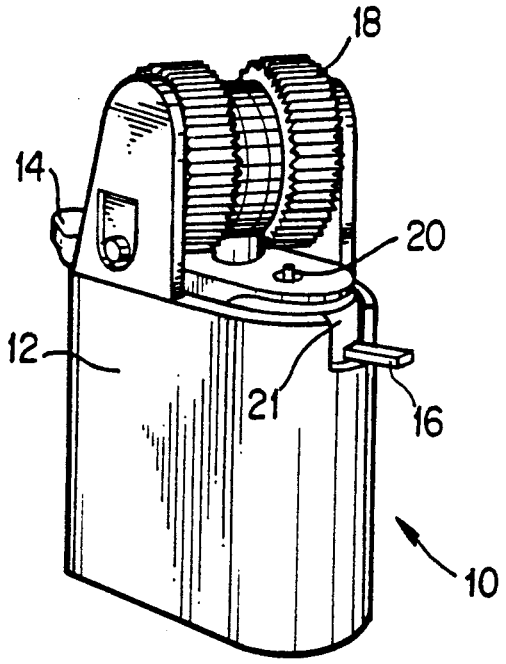
FIG. 1 is a perspective view of a preferred embodiment of a selectively actuatable child resistant lighter of the present invention in a locked configuration.

Referring initially to FIG. 1, there is depicted, in a default or at-rest configuration, the lighter of the present invention comprising a main body portion 12, a depressable valve actuator 14, a locking latch 16, a spark-producing wheel 18 and a hollow fuel nozzle 20. A wind guard is included in this embodiment but is not depicted in FIG. 1 so as to better illustrate other elements of the lighter. Advantageously, the default configuration is also a locked configuration in which depression of valve actuator 14 will not result in the flow of fuel. More specifically, depression of valve actuator 14 while the lighter is in a locked configuration does not result in the flow of fuel since locked locking latch 16 prevents upward movement or lifting of fuel nozzle 20 regardless of the position of the valve actuator. Such movement or lifting of fuel nozzle 20 is necessary for fuel to flow through the fuel nozzle and is the manner in which a fuel valve is actuated.

Depression of valve actuator 14 while the lighter is in an unlocked state permits fuel to flow through fuel nozzle 20 and to be ignited by sparks produced by spark-producing wheel 18 frictionally engaging a flint (not shown). Advantageously, unless locking latch 16 is positioned away from its depicted at-rest or default position and into a position defined by notch 21 formed in main body portion 12, any attempted depression of valve actuator 14 will not result in the flow of fuel and the lighter will be inoperable. The position of locking latch 16 as shown in FIG. 1 may best be characterized as a "default position" under normal conditions.

A user typically holds the main body portion of the lighter in his hand, rotates with his thumb the spark-producing wheel in a direction toward a finger depressable surface of the valve actuator to produce a spark, while depressing the valve actuator to allow lifting of the fuel nozzle and passage of fuel through the fuel nozzle. The spark produced by the wheel ignites the fuel. This is a relatively conventional structure for most lighters, including disposable lighters.

Figure 2:
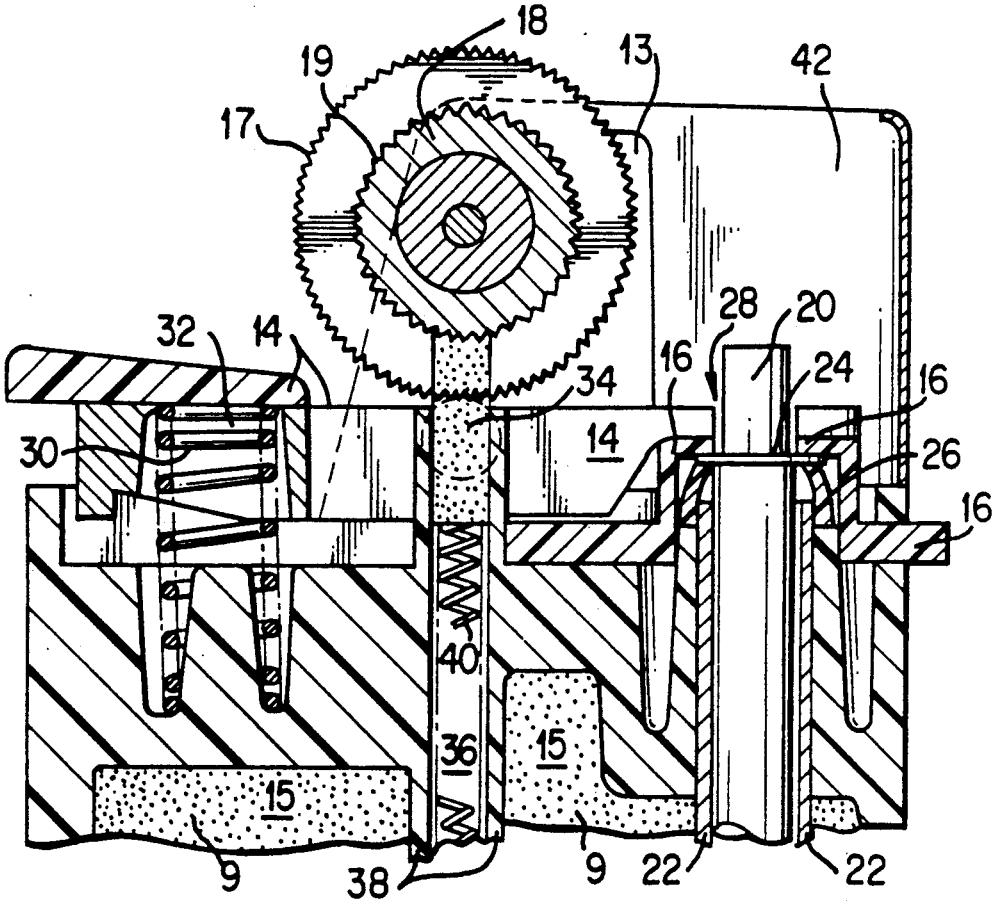
FIG. 2 is a partial cross-sectional view of the child resistant lighter of FIG. 1 depicting the lighter in a locked configuration.

Referring now to FIG. 2, there is depicted a cross-section of the lighter of FIG. 1 in a locked configuration with the fuel nozzle fully inserted into the valve housing. More particularly, valve actuator 14 is pivotally mounted between side wall portions 13 which comprise extensions of the side walls of body portion 12. Valve actuator 14 is attached to hollow fuel nozzle 20 slidably supported within a valve housing 22. Hollow fuel nozzle 20 is provided with a flange 24. Resilient means, such as an elastomeric ring 26, depicted in FIG. 2 in a compressed state, provides an upwards force to flange 24, thereby biasing flange 24 and nozzle 20 upwards. However, locking latch 16 provides a downwards force on flange 24. Since the downwards force exerted by locking latch 16 in a locked configuration is greater than the upwards force on flange 24 provided by elastomeric ring 26, nozzle 20 tends to remain in its fully inserted position as indicated in FIG. 2, thereby preventing the flow of fuel through the nozzle. Valve actuator 14 provides further downwards force on flange 24 via locking latch 16.

The valve means (not shown) permits fuel to flow through nozzle 20 only when nozzle 20 is lifted upwards. Nozzle 20 can only be lifted upwards by removing the downward forces exerted by each of locking latch 16 and valve actuator 14. Since each of these downward forces exerted by locking latch 16 and valve actuator 14 is greater than the upwards force exerted by elastomeric ring 26, the valve tends to remain in the closed position and fuel is prevented from flowing.

Elastomeric ring 26 is preferably constructed from synthetic or natural rubber which may be molded. Alternatively, elastomeric ring 26 may be constructed from other resilient materials and may take the form of sufficiently flexible metallic spring means. The elastomeric ring preferably has upper and lower substantially flat surfaces, and a cross sectional configuration defined by an inner wall and an outer wall concentric with the inner wall. The inner and outer walls each have a concave configuration to minimize the change of the biasing force between valve open and valve closed positions. Advantageously, the elastomeric ring is dimensioned and positioned to provide suitable upwards biasing force to the locking latch. U.S. Pat. No. 4,889,482 describes illustrative resilient means and is incorporated herein by reference.

The ring is compressed and the valve is closed when the fuel nozzle is fully inserted into the valve housing. In this configuration, the ring provides sufficient biasing force for opening the valve when the ring is allowed to expand towards its original configuration. Advantageously, the downwards biasing force provided by the locking latch on the fuel nozzle due to the locked position of the locking latch as well as the downwards force provided by the valve actuator on the locking latch must each be removed in order for the ring to expand, i.e., the upwards biasing force exerted by the elastomeric ring to open the valve.

In an alternative embodiment, the resilient means comprises metallic spring means positioned in engagement with the valve housing and normally maintained in a compressed state.

Valve actuator 14 is provided with a bore 28 having sufficient diameter to enable movement of nozzle 20 therethrough. A compressed spring 30 resides partially within a recess 32 formed in valve actuator 14 and applies a downwards biasing force to locking latch 16 which causes fuel nozzle 20 to be urged downward into valve housing 22 and body portion 12. In particular, compressed spring 30 causes valve actuator 14 to apply force to locking latch 16 which applies force to flange 24 thereby urging nozzle 20 downward into valve housing 22 and body portion 12 and preventing lifting of nozzle 20 and the flow of fuel through nozzle 20. In such an embodiment, depression of valve actuator 14 serves to remove a force maintaining the fuel nozzle in a down position and the valve closed. Alternatively, depression of valve actuator 14 may lift nozzle 20 by the application of force to another flange (not shown) in order to expel fuel.

A conventional valve assembly (not shown, but see U.S. Pat. No. 4,773,849 incorporated herein by reference) is located near the recessed end of nozzle 20 and permits fuel to flow through nozzle 20 only when nozzle 20 is lifted. In particular, the valve assembly includes a valve seal attached to one end of the fuel nozzle and a valve seat adapted for fuel flow therethrough and for engagement with the valve seal. The valve seal engages the valve seat when the fuel nozzle is urged downwards, i.e., fully inserted into the valve housing, thereby preventing fuel flow. If the valve seal is displaced from the valve seat, i.e., the fuel nozzle is not fully inserted, fuel may flow through the valve seat and into the fuel nozzle. In this regard, "fully inserted" refers to the position of the fuel nozzle when it cannot be inserted into the valve housing any deeper due to the abutment of the valve seat against the valve seal.

Lighter 10 further comprises a sparking flint 34 mounted within a bore 36 defined by flint and spring housing 38 in main body 12. Flint 34 is urged toward spark-producing wheel 18 by spring 40. Sparking wheel 18, which includes a toothed surface 19 which is preferably suitably hardened and against which flint 34 is urged, is mounted for rotation between side wall extension portions 13 in a conventional manner. Toothed surface 19 includes suitable indentations which define teeth such that when sparking wheel 18 is rotated toothed surface 19 cuts against flint 34 causing the generation of ignition sparks. Additionally, sparking wheel 18 includes suitable indentations 17 which facilitate rotation of sparking wheel 18 by an operator's finger.

Main body 12 defines an internal chamber 15 which is filled with a fuel 9 such as butane fuel capable of vaporizing in a conventional manner to produce a gaseous medium which passes through fuel nozzle 20 under the control of a valve. Main body 12 is constructed from any suitable structural material and is preferably constructed from a plastic material. Polyacetal is a preferred material for main body 12. However, alternative materials such as styrene acrylonitrile, polyester, nylon or the like may be used. A shield 42, preferably constructed from metal, is provided and functions as a wind guard around the flame thereby assisting in the ignition of the fuel.

As depicted in FIGS. 1 and 2, notched opening 21 is provided in body portion 12 to accommodate locking latch 16 and, in particular, lateral and upwards movement of locking latch 16. As will be appreciated, FIGS. 1 and 2 depict the lighter of the present invention in a locked configuration, i.e., a default configuration. In this locked configuration, locking latch 16 prevents fuel nozzle 20 from being lifted an amount sufficient to activate a valve and enable fuel to flow through nozzle 20.

Figure 3:
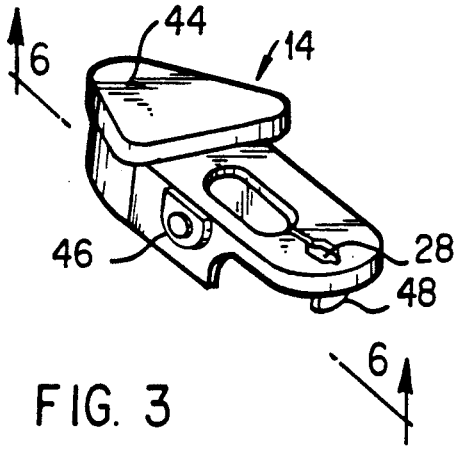
FIG. 3 is a perspective view of a valve actuator depicted in FIGS. 1 and 2.

Referring now to FIG. 3, there is depicted valve actuator 14 in greater detail. Valve actuator 14 comprises a finger depressable surface 44, extensions 46, a bore 28 and a tab 48. Once the lighter is unlocked, a user desiring to actuate the lighter depresses finger depressable surface 44. Extensions 46 are provided to matingly engage with bores in side wall portions 13 of body portion 12 to provide pivotal movement of the valve actuator about extensions 46. Bore 28 is adapted for surrounding a portion of fuel nozzle 20 above flange 24. As will be appreciated, tab 48 is provided for engagement with an indentation such as a notch in the locking latch so as to maintain the lighter in an unlocked configuration in which the valve actuator may be depressed to enable lifting of the fuel nozzle and the flow of fuel.

Figure 4:
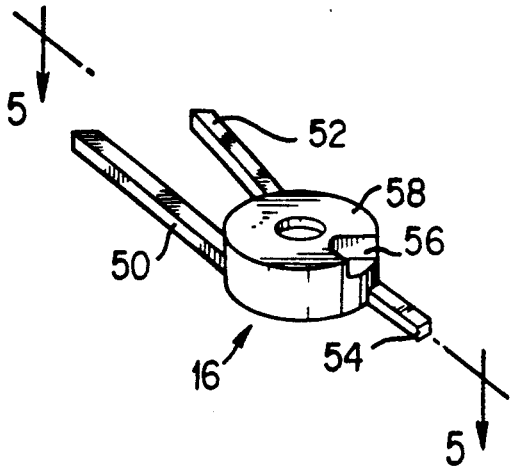
FIG. 4 is a perspective view of a locking latch depicted in FIGS. 1 and 2.

FIG. 4 depicts locking latch 16 in greater detail. Safety latch 16 is provided with pivoting extensions 50, 52 which facilitate deflection and stabilization of locking latch 16 within body portion 12 and assures proper positioning and retention of locking latch 16 around nozzle 20 and elastomeric ring 26 as well as in notched opening 21 especially when the locking latch is moved. Each of extensions 50, 52 is dimensioned and structured to respectively engage an inner wall or a structural member of the lighter housing when locking latch 16 is moved in a lateral, or cross-wise, direction. Locking latch 16 is also provided with a finger actuated portion 54 which is movable in a lateral direction to an unlocked position. A notch 56 is formed in an upper surface 58 of the locking latch. In the locked or closed configuration depicted in FIGS. 1 and 2, tab 48 of valve actuator 14 rests against an upper surface 58 of locking latch 16. As will be appreciated, lateral movement of finger actuated portion 54 a sufficient amount causes tab 48 of valve actuator 14 to engage notch 56 in locking latch 16. Once tab 48 engages notch 56, finger actuated portion 54 will remain in the unlocked position until the valve actuator is depressed at which point fuel can flow through nozzle 20.

Figure 5:
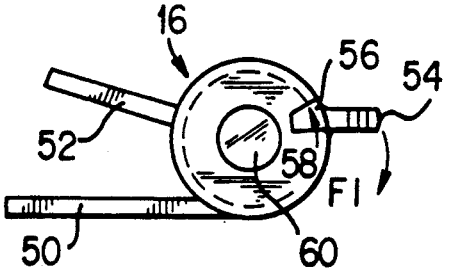
FIG. 5 is a top view along line 5—5 of the locking latch depicted in FIG. 4.

Referring to FIG. 5, there is illustrated a view of the topside of locking latch 16 taken along line 5—5 in FIG. 4. Finger actuated portion 54 of locking latch 16 is flexible in a first direction F1 a sufficient amount so as to position notch 56 around tab 48 of valve actuator 14. An opening 60 accommodates fuel nozzle 20 and is of sufficient diameter so as not to restrict movement of nozzle 20, except that opening 60 cannot accommodate flange 24 of nozzle 20.

Advantageously, locking latch 16 can be inserted into the lighter and positioned around nozzle 20 after the otherwise complete assembly of the lighter, thus not significantly interfering with or slowing down the assembly process of the lighter, or requiring extensive modification of devices presently employed to produce conventional lighters. It is desirable that the material from which latch 16 is constructed is relatively rigid material which is sufficiently resilient to permit movement of finger actuated portion 54 towards a section of body 12 defined by notch 21 so as to place the lighter in an unlocked configuration. Safety latch 16 is preferably constructed of polyetherimide. Illustrative of alternative materials from which locking latch 16 may be constructed include polysulfone, polyethersulfone, or any sufficiently resilient metal or elastomer, as well as a wide variety of other suitable materials.

Figure 5A:
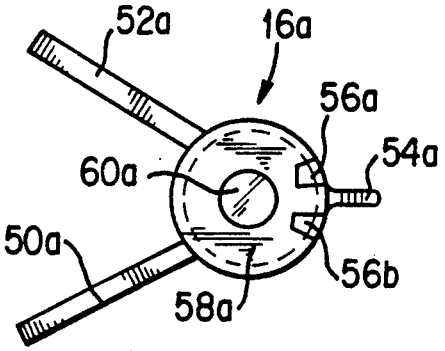
FIG. 5*a* is a top view of an alternate embodiment of a locking latch.

FIG. 5*a* depicts an alternate embodiment of a locking latch 16*a*. This embodiment, along with a suitably enlarged notch in main body portion 12 (see notch 21 in FIG. 1) provides for a bidirectionally unlockable lighter. In particular, this embodiment provides for a locked position of locking latch 16*a* in which finger actuated portion 54*a* is centrally located and two unlocked positions of locking latch 16*a* in which finger actuated portion 54*a* is offset to either side of its centrally located locked position.

Figure 6:
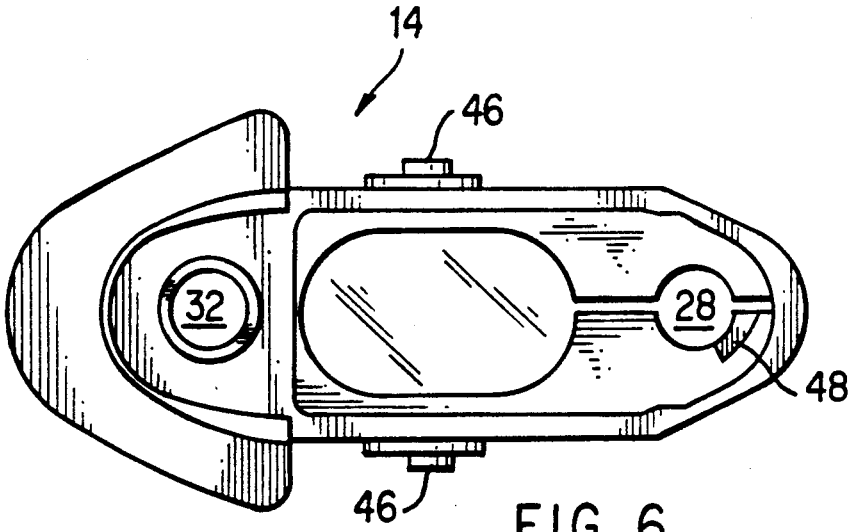
FIG. 6 is a bottom view along line 6—6 of the valve actuator depicted in FIG. 3.

Referring now to FIG. 6, there is depicted a view of the underside of valve actuator 14 along line 6—6 in FIG. 3. Recess 32 is adapted to receive spring 30 as depicted in FIG. 2 and may take on a variety of forms such as an indentation or a bore partially into valve actuator 14. Valve actuator 14 is constructed from material having sufficient dimensional stability and rigidity to continuously over the life of the lighter assure proper relative positioning between tab 48 of valve actuator 14 and notch 56 of locking latch 16. Actuator 14 is preferably constructed from glass filled polyetherimide. Other illustrative materials from which valve actuator 14 may be constructed are zinc, brass, aluminum and other glass filled polymers such as polysulfone, polyethersulfone or the like.

Figure 7:
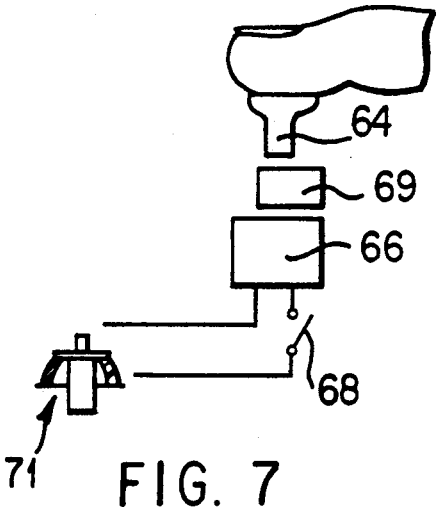
FIG. 7 is a schematic diagram depicting a piezoelectric lighter apparatus in which the present invention may be employed and having an optional switch depicted in the open position and a locking means depicted in the locked position to prevent the production of sparks and the flow of fuel.

FIG. 7 schematically depicts a piezoelectric type lighter in which the present invention may be employed. The piezoelectric lighter comprises hammer and fuel release means 64, spark providing means 66, electrical cut-off switch 68, locking means 69 and valve means 71. The piezoelectric lighter operates in a conventional manner except for locking means 69 which is operative on the fuel supply in accordance with the present invention. Illustratively, such a locking means comprises a locking latch which preferably prevents the flow of fuel as previously described, as well as preventing the production of sparks. In particular, locking means 69 may prevent the production of sparks by electrically isolating an energy source from the spark producing means. Alternatively, the locking means may be arranged to selectively prevent only the flow of fuel or it may be arranged to selectively prevent the generation of sparks. As depicted in FIG. 7, the lighter is in a locked configuration since locking means 69 is positioned so as to prevent the flow of fuel and/or the generation of sparks. Additionally, switch 68 is depicted in an open, or off, position.

Figure 8:
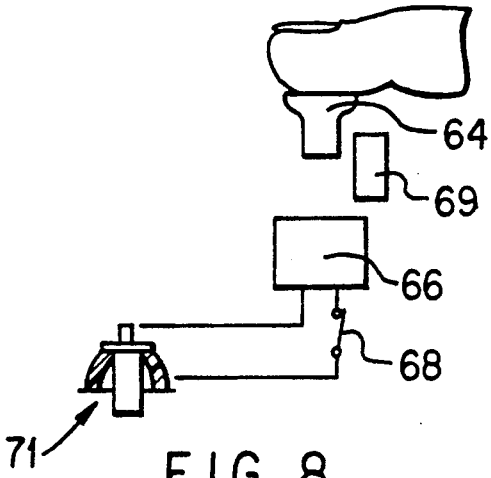
FIG. 8 is a schematic diagram depicting the piezoelectric lighter of FIG. 7 with the switch depicted in the closed position and the locking means depicted in an unlocked position.

FIG. 8 schematically depicts the piezoelectric type lighter of FIG. 7 in an unlocked configuration. In particular, locking means 69 is positioned so as to enable the fuel nozzle to be lifted upon actuation of hammer means 64. Additionally, switch 68 is depicted in a closed, or on, position.

Figure 9:
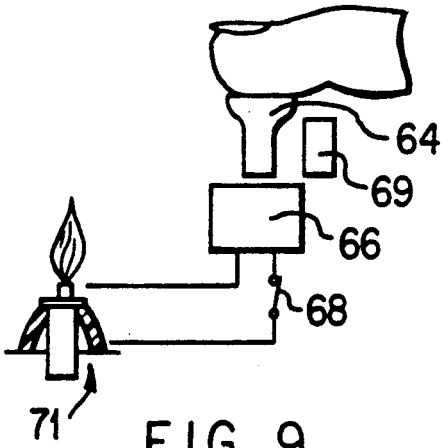
FIG. 9 is a schematic diagram depicting the piezoelectric lighter of FIG. 8 in an unlocked configuration and depicting a flame.

FIG. 9 schematically depicts the piezoelectric type lighter of FIG. 8 in an unlocked configuration in which hammer means 64 has been depressed and the fuel nozzle lifted enabling the flow of fuel.

Figure 10:
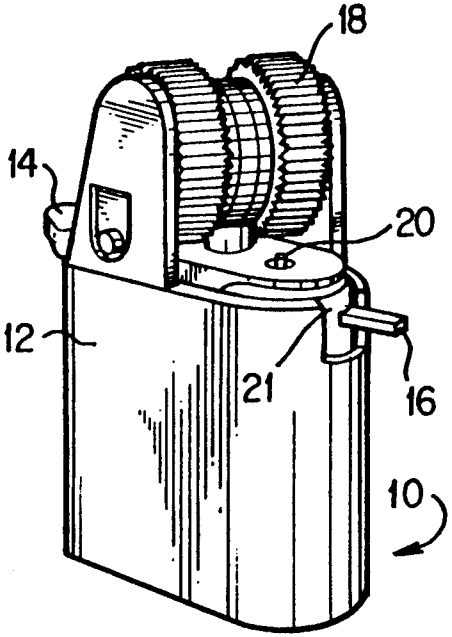
FIG. 10 is a perspective view of a preferred embodiment of a selectively actuable child resistant lighter in a locked configuration.
Figure 11:
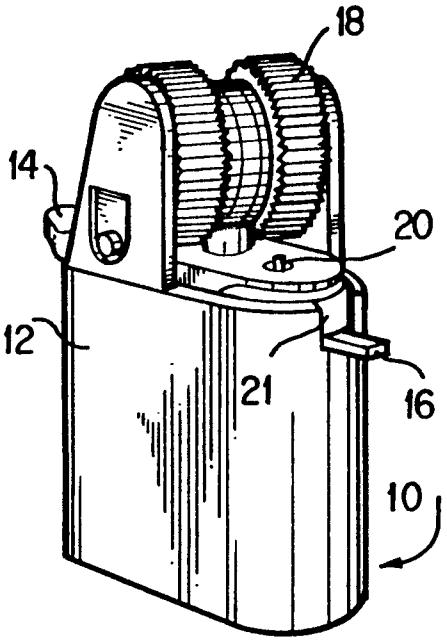
FIG. 11 is a perspective view of a preferred embodiment of the child resistant lighter in an unlocked configuration in which the position of the locking latch is moved from its at-rest locked position to a position which enables lifting of the fuel nozzle and depression of the valve actuator so as to allow a valve to be opened and release gas through the fuel nozzle.
Figure 12:
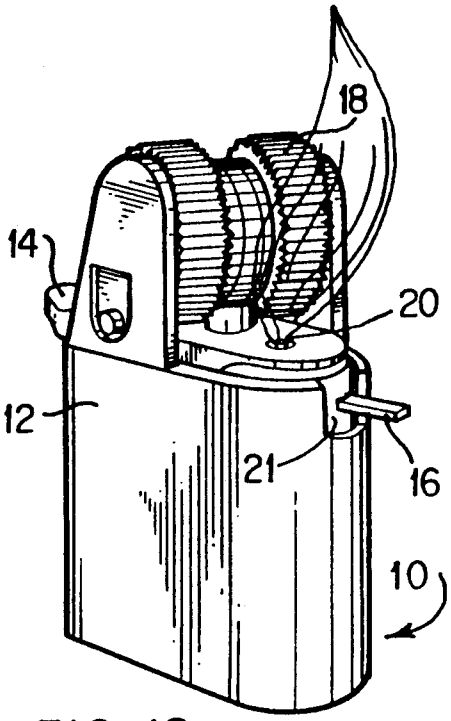
FIG. 12 is a perspective view of the child resistent lighter of FIG. 11 with the valve actuator in a depressed position and depicting a flame.

In operation of the present invention, and as depicted in FIGS. 10–12 (which do not depict a wind guard for ease of illustration), a user must first move locking latch 16 in a lateral direction so as to sufficiently displace notch 56 of locking latch 16 into engagement with tab 48 of valve actuator 14. Such movement is indicated in the transition from FIG. 10 (locked configuration) to FIG. 11 (unlocked configuration). The mating of tab 48 into notch 56 advantageously enables the lighter to maintain the unlocked configuration depicted in FIG. 11 without the application of force by a user. Advantageously, forces provided by pivoting extensions 50 and 52 which urge tab 48 against a side of notch 56 facilitate retention of the lighter and, in particular, locking latch 16, in an unlocked and undepressed position as depicted in FIG. 11. Depression of valve actuator 14 of FIG. 11 at this point combined with and preferably preceded by rotation of spark-producing wheel 18 will cause the lighter to operate, as indicated in FIG. 12. In particular, the sparks thus produced will ignite the gaseous fuel which is expelled from nozzle 20 when valve actuator 14 releases its downward pressure on locking latch 16 thus enabling the elastomeric ring to push the locking latch upwards and to also lift the fuel nozzle upwards, thereby actuating the valve. The lifting action which the elastomeric ring provides to flange 24 (FIG. 2) of nozzle 20 partially relieves the pressurized condition in the fuel chamber thereby permitting the flow of fuel as a gaseous medium through nozzle 20 and the subsequent burning of such fuel. As will be appreciated, depression of valve actuator 14 of FIG. 11 is accompanied by a lifting or upwards movement of the locking latch. Such upwards movement of the locking latch is due to an upwards force exerted on locking latch 16 by the elastomeric ring and tending to pull locking latch 16 upwards as valve actuator 14 is depressed. Additionally, such upwards movement of locking latch 16 is followed by a lateral movement of the locking latch to the unlocked position indicated in FIG. 12. Such lateral movement is accompanied by and due to disengagement of tab 48 and notch 56. In particular, depression of the depressable surface of valve actuator 16 causes, subsequent to the upwards movement of the locking latch, tab 48 to move out of engagement with notch 56. Accordingly, once the depressable surface is released, tab 48 exerts sufficient downward force on surface 58 of locking latch 16 (FIG. 4) so as to force nozzle 20 downward and stop the flow of fuel.

Thus, the presently preferred embodiment of the invention may be placed in an unlocked configuration from its default locked configuration by moving finger actuated portion 54 of the locking latch in a lateral direction so as to place tab 48 of actuator 14 into engagement with notch 56 of latch 16. As one skilled in the art will appreciate, once the locking latch is moved so as to place tab 48 into engagement with notch 56, the lighter will remain in its unlocked configuration due to the force which the valve actuator exerts on the locking latch and, in particular, to the force exerted by tab 48 on notch 56, at least until tab 48 and notch 56 disengage each other.

Figure 13:
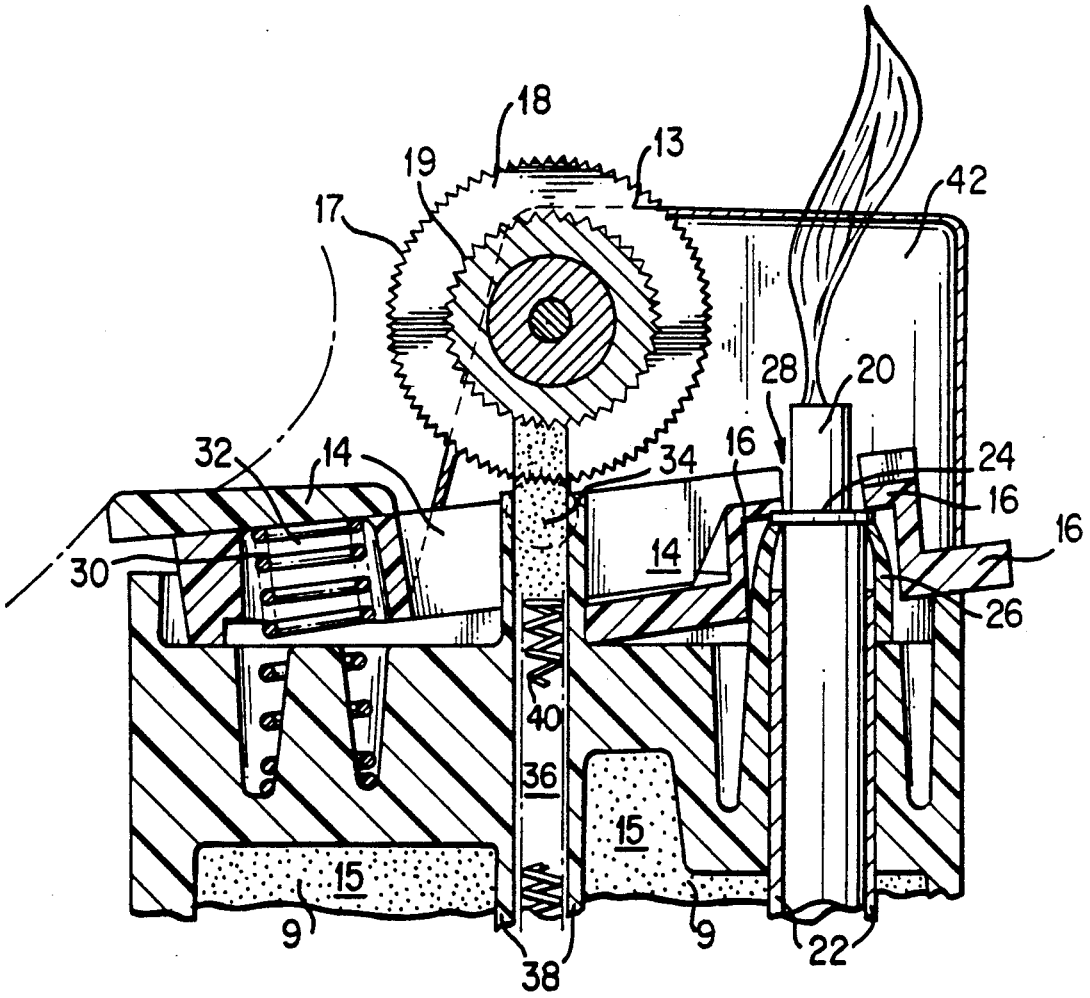
FIG. 13 is a partial cross-sectional view of a preferred embodiment of the child resistant lighter depicting the lighter in an unlocked and depressed configuration and with a flame.

Referring now to FIG. 13, there is depicted a partial cross-sectional view of the lighter of the present invention in an unlocked and depressed configuration. As will be appreciated, movement of finger actuated portion 54 of locking latch 16 and, in particular, engagement of notch 56 of latch 16 with tab 48 of actuator 14, will permit unimpeded depression of the valve actuator as depicted in FIG. 13.

More specifically, such movement of locking latch 16 followed by depression of valve actuator 14 will cause compression of spring 30 and permit elastomeric ring 26 to urge fuel nozzle 20 upward and partially out of valve housing 22 and body portion 12. In contrast to the compressed state of elastomeric ring 26 in FIG. 2, ring 26 is depicted in an expanded state in FIG. 13, thereby urging nozzle 20 upwards. Such lifting of fuel nozzle 20 upward will permit fuel to flow from chamber 15 through the valve (not shown) and out of nozzle 20 whereupon it will have been ignited by sparks produced by flint 34 and toothed surface 19 of spark-producing wheel 18. Hollow fuel nozzle 20 is held within valve housing 22 by flange 24 and locking latch 16.

FIGS. 14–18 depict the sequence of operations required for the unlocking and locking of the lighter by suitably positioning the locking latch and depressing the valve actuator. Spaces are depicted between various elements of the lighter for ease of illustration. In particular, FIG. 14 depicts locking latch 16 and valve actuator 14 in the default or locked position. In this position, depression of valve actuator 14 by finger pressure on surface 44 (FIG. 3) will not result in nozzle 20 being lifted since the locked state of locking latch 16 prevents any upward movement of nozzle 20. Additionally, tab 48 of actuator 14 supplies a downwards force to surface 58 of latch 16.

FIG. 15 depicts locking latch 16 in an unlocked position and valve actuator 14 in an undepressed position. Finger actuated portion 54 of locking latch 16 has been moved in a direction indicated by the arrow, providing alignment of notch 56 directly under tab 48 so as to enable tab 48 of valve actuator 14 to enter notch 56 of locking latch 16. As depicted, portion(s) of locking latch 16 are under compressive loading. Advantageously, absent any operator-applied forces, holding pressure exerted by tab 48 onto a wall defined by notch 56 in conjunction with forces provided by pivoting extensions 50 and 52, maintains locking latch 16 in the unlocked position depicted in FIG. 16. In other words, due to the compressive loading which locking latch 16 is under when tab 48 engages notch 56, removal of operator-applied pressure from finger actuated portion 54 once tab 48 has been engaged with or inserted into notch 56, will not result in finger actuated portion 54 slipping toward a void 70 but will maintain the lighter in the unlocked configuration depicted in FIG. 16, until the depressable surface of valve actuator 14 is depressed.

Application of finger pressure to finger depressable surface 44 (FIG. 3) of valve actuator 14 as depicted in FIG. 16 will yield the configuration depicted in FIG. 17 in which valve actuator 14 has been depressed thereby removing downward forces on nozzle 20 and permitting fuel to flow through the valve (not shown) and fuel nozzle 20. In particular, as valve actuator 14 is depressed, tab 48 of the valve actuator is lifted upwards urging locking latch 16 upwards toward its unlocked position as indicated in FIG. 17. Safety latch 16 is moved upwards until the forces tending to move latch 16 upwards are overcome by the forces resisting such upwards movement, at which point tab 48 will advantageously disengage from notch 56 and finger actuated portion 54 of latch 16 will move lateral to the position indicated in FIG. 17. The forces tending to move latch 16 upwards include forces exerted by elastomeric ring 26 to latch 16 by way of flange 24 (FIG. 13). Provided that spark-producing wheel 18 (FIG. 13) was actuated in combination with valve actuator 14 being depressed, the fuel flowing through the fuel nozzle will be ignited. Such fuel will continue to flow and burn as long as sufficient pressure is maintained on valve actuator 14.

Once pressure is removed from valve actuator 14, the depressible surface of the valve actuator will move upward due to the biasing force provided by spring 30 as indicated in FIG. 2, and the flame will be extinguished. Referring now to FIG. 18, as the depressable surface of valve actuator 14 moves upward, locking latch 16 is forced downwards into its locked position due to the force exerted by tab 48 on surface 58 of latch 16. Once tab 48 forces surface 58 downward a sufficient amount, portion 54 advantageously may return to its locked position since tab 48 does not restrain such movement as it would if it would engage notch 56 at this point. Advantageously, forces tending to move the fuel nozzle upwards are significantly less than the force supplied by tab 48 on surface 58 tending to move the nozzle downwards. In fact, the downward force supplied by valve actuator 14 on nozzle 20 by way of latch 16 are at all times greater than any forces urging nozzle 20 upwards as well as frictional forces tending to keep nozzle 20 in the position indicated in, for example, FIG. 17. Accordingly, as long as a user is not depressing the valve actuator, the nozzle will be urged downward thereby preventing the flow of fuel. Once the portion of valve actuator 14 surrounding nozzle 20 moves upward an amount sufficient to disengage tab 48 from notch 56, portion 54 moves in the direction indicated by the arrow in FIG. 18 towards its at-rest locked position.

As one skilled in the art will appreciate, the size, shape and location of tab 48, notch 56, notch 21, void 70 etc. is not limited to that depicted in FIGS. 14–18. A wide variety of mechanisms which prevent fuel valve actuation may be employed in the present invention. For example, tab 48 may be rectangular in shape, and portion 54 may have rounded corners or a slanted upper surface. Means alternative to a tab and mating notch may be used.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

More specifically, the locking mechanism and lighter disclosed and claimed herein are not limited to use in disposable lighters. Moreover, the present invention is in no way limited to a locking mechanism in which a tab in a valve actuator engages a notch in a locking latch, or the use of lateral movement to unlock the lighter. For example, any of a wide variety of locking mechanisms or actions may be employed, such as mechanisms having right-left, front-rear, over and down, in and over, etc. type actions. Additionally, while it has been found that the present embodiment as described may be used by both right and left handed users, the positioning and direction of movement of elements may be reversed.

What is claimed is:

1. A flame producing lighter which comprises:

a housing defining reservoir for containing a combustible gaseous medium under pressure;

fuel nozzle means associated with said housing defining reservoir for expelling said gaseous medium therefrom;

valve means operatively associated with said fuel nozzle means and arranged for selective actuation between a normally closed position in which said fuel nozzle means is in a first position to prevent exit of said gaseous medium from said reservoir, and an open position in which said fuel nozzle means is in a second position to permit exit of gaseous medium from said reservoir through said valve means;

means for selectively producing sparks at a location proximate said fuel nozzle means for selectively causing ignition of said gaseous medium;

means including a locking latch normally positioned for preventing movement of said valve means to the open position by preventing movement of said fuel nozzle means from said first position to said second position;

valve actuator means for providing a first biasing force to said nozzle movement prevention means to maintain said fuel nozzle means in said first position, said valve actuation means being depressible to remove said first biasing force;

means for selectively moving said nozzle movement prevention means laterally from a normally locked position towards at least one of two opposite sides of said housing to an unlocked position in which movement of said fuel nozzle means from said first position to said second position is permitted and whereby actuation of said valve means to the open position is permitted upon depression of said valve actuator means, thereby selectively permitting exit of said combustible gaseous medium from said valve means and ignition of said gaseous medium by sparks produced by said spark-producing means; and means to retain said locking latch in said unlocked position at least until said valve actuator means is depressed whereupon release of said valve actuator means causes said locking latch to move back to its locked position.

2. The flame producing lighter according to claim 1 further comprising means for biasing said fuel nozzle means from said first position to said second position wherein said valve means is actuated to the open position by removing said first biasing force and a second biasing force supplied by said nozzle movement prevention means, thereby enabling said fuel nozzle biasing means to urge said fuel nozzle means from said first position to said second position.

3. The flame producing lighter of claim 2 wherein said fuel nozzle biasing means comprises an elastomeric ring.

4. The flame producing lighter according to claim 1 wherein the movement of said locking latch from said normally locked position to said unlocked position is resiliently provided.

5. The flame producing lighter according to claim 4 wherein the resilient movement of said locking latch causes said locking latch to automatically return to its locked position and to return said fuel nozzle means to its first position when said valve actuator means again provides said first biasing force after being depressed and released, thus preventing said valve means from opening.

6. The flame producing lighter according to claim 5 wherein said locking latch comprises an arcuate body, first and second extensions projecting away from said body and a finger actuatable portion.

7. The flame producing lighter according to claim 6 wherein said first and second extensions are dimensioned and structured to respectively engage an inner wall of the lighter housing when said locking latch is moved to the unlocked position.

8. The flame producing lighter according to claim 7 wherein said arcuate body comprises an opening to accommodate said fuel nozzle.

9. The flame producing lighter according to claim 1 wherein said retention means comprises a suitably located tab on said valve actuator means and a suitably located notch in said locking latch for engagement with said tab when said locking latch is in said unlocked position.

10. The flame producing lighter according to claim 1 wherein said valve means comprises a valve seal attached to an end of said fuel nozzle means and a valve seat adapted for fuel flow therethrough and for engagement with said valve seal, said valve seal engaging said valve seat when said fuel nozzle means is in said first position thereby preventing fuel flow, and said valve seat not engaging said valve seat when said fuel nozzle means is in said second position.

11. The flame producing lighter according to claim 1 wherein said means for selectively producing sparks comprises flint material and a rotatable spark-producing wheel having a toothed surface positioned and arranged to selectively frictionally contact said flint material.

12. The flame producing lighter according to claim 1 wherein said means for selectively producing sparks comprises electric spark-producing means.

13. The flame producing lighter according to claim 1 wherein said means for selectively producing sparks comprises piezoelectric spark-producing means.

14. A flame producing lighter having a locking mechanism comprising:

means for normally preventing actuation of a fuel supply, said means including a fuel nozzle normally in a first position which prevents flow of fuel and movable to a second position which permits flow of fuel;

a depressible valve actuator which normally supplies a biasing force tending to keep said fuel nozzle in said first position and which, upon depression, removes said biasing force;

a locking latch normally positioned so as to maintain said fuel nozzle in said first position even if said depressible valve actuator is depressed, wherein application of an external force to said locking latch moves said locking latch laterally towards at least one of two opposite sides of said housing from an operable position into an inoperative position in which said fuel nozzle is permitted to move from said first position to said second position and in which depression of said valve actuator enables said fuel nozzle to move from said first position to said second position; and spring means to bias said fuel nozzle from said first position into said second position, wherein a force exerted by said spring means is less than said biasing force exerted by said depressible valve actuator, wherein such selective actuation of said fuel supply and a corresponding production of sparks by spark-producing means ignites fuel from said fuel supply.

15. The fuel cutoff locking mechanism according to claim 14 wherein said spring means comprises an elastomeric ring.

16. The fuel cutoff locking mechanism according to claim 14 wherein said actuation prevention means comprises a valve seal attached to an end of said fuel nozzle and a valve seat adapted for fuel flow therethrough and for engagement with said valve seal, said valve seal engaging said valve seat when said fuel nozzle is in said first position thereby preventing fuel flow, and said valve seal not engaging said valve seat when said fuel nozzle is in said second position.

17. The fuel cutoff locking mechanism according to claim 14 wherein said movement of said locking latch is resiliently provided so as to automatically return said locking latch to said operable position when said depressable valve actuator is released, thus maintaining said fuel nozzle in said first position to prevent flow of fuel therethrough.

18. The fuel cutoff locking mechanism according to claim 17 further comprising means to retain said locking latch in said inoperable position in which depression of said valve actuator enables movement of said fuel nozzle at least until said valve actuator is depressed, and wherein said inoperable position is any of a plurality of inoperative positions.

19. The fuel cutoff locking mechanism according to claim 18 wherein said retention means comprises a suitably located tab on said valve actuator and a suitably located notch in said locking latch for engagement with said tab when said locking latch is in said position in which depression of said valve actuator enables movement of said fuel nozzle.

20. A flame producing lighter comprising:

housing;

fuel supply means for supplying fuel to be ignited;

ignition means for igniting fuel;

valve means including fuel nozzle means for selectively permitting flow of said fuel, said fuel nozzle means normally in a first position which prevents flow of said fuel, and being biased by a first biasing means towards a second position which permits flow of said fuel, said first biasing means supplying a first biasing force;

valve actuator means for supplying a second biasing force which is greater than and opposite to said first biasing force to retain said fuel nozzle means in said first position; and means for selectively unlocking said lighter from a normally locked configuration in which said fuel nozzle means is maintained in said first position by said selectively unlocking means, said selectively unlocking means being movable laterally towards at least one of two opposite sides of said housing to an unlocked position, and said selectively unlocking means being operable by a user's finger, said selectively unlocking means having a locking latch which normally confines said fuel nozzle means to said fuel nozzle means first position even if said depressible valve actuator is depressed and wherein said valve actuator means includes a valve actuator which, when in a first position, supplies said second biasing force, said valve actuator being depressible so as to remove said second biasing force, wherein positioning said selectively unlocking means into said unlocked position by a user selectively applying a third biasing force to said locking latch enables removal of said second biasing force by depressing said valve actuator means thereby permitting said first biasing means to urge said fuel nozzle means towards said second position for permitting flow of said fuel.

21. The flame producing lighter according to claim 20 wherein said third biasing force is applied in a lateral direction towards at least one of two opposite sides of said housing and is resiliently provided so as to automatically return said locking latch to its normal position and said fuel nozzle means to its first position when said valve actuator is released, thus preventing said valve means from opening.

22. The flame producing lighter according to claim 20 wherein first biasing means comprises an elastomeric spring means.

23. The flame producing lighter according to claim 20 further comprising means to retain said locking latch in said unlocked position at least until said valve actuator means is depressed, and wherein said unlocked position is any one of a plurality of unlocked positions.

24. The flame producing lighter according to claim 23 wherein said retention means comprises a suitably located tab on said valve actuator and at least one suitably located notch in said locking latch for engagement with said tab when said locking latch is in said unlocked position.

25. The flame producing lighter according to claim 20 wherein said valve means comprises a valve seal attached to an end of said fuel nozzle means and a valve seat adapted for fuel flow therethrough and for engagement with said valve seal, said valve seal engaging said valve seat when said fuel nozzle means is in said first position thereby preventing fuel flow, and said valve seal not engaging said valve seat when said fuel nozzle means is in said second position.

26. The flame producing lighter according to claim 20 wherein said ignition means comprises a spark-producing wheel and a flint urged against said wheel and wherein sparks are produced by rotation of said wheel.

27. The flame producing lighter according to claim 20 wherein said ignition means comprises electric spark-producing means.

28. The flame producing lighter according to claim 20 wherein said ignition means comprises piezoelectric spark-producing means.

29. An improved flame producing lighter of the type having a housing, a fuel supply, valve means for selectively supplying fuel from said fuel supply to a fuel nozzle and spark-producing means for producing sparks, said fuel nozzle being movable so as to selectively actuate said valve means, wherein the improvement comprises means for selectively permitting actuation of said valve means thereby selectively permitting exit of fuel from said fuel supply through said valve means and ignition of said fuel by sparks produced by said spark-producing means, said means for selectively permitting actuation including pivotally mounted actuator means and a locking latch normally in a locked position in which said locking latch prevents actuation of said valve means by preventing movement of said fuel nozzle even if said pivotally mounted actuator means is actuated, said locking latch being movable laterally towards at least one of two opposite sides of said housing to an unlocked position in which said fuel nozzle is allowed to move from said first position to said second position and in which said locking latch permits actuation of said valve means by permitting movement of said fuel nozzle upon depression of said actuator means.

30. The improved flame producing lighter of claim 29 further comprising means for retaining said locking latch in said unlocked position at least until said actuator means is depressed.

31. The flame producing lighter according to claim 30 wherein said retention means comprises a suitably located tab on said actuator means and at least one suitably located notch in said locking latch for engagement with said tab when said locking latch is in said unlocked position.

32. The improved flame producing lighter of claim 31 wherein the movement of said locking latch from said locked position to said unlocked position is resiliently provided so as to automatically return said locking latch to its locked position when said actuator means is released, thereby preventing flow of fuel.

33. A flame developing lighter comprising:

housing;

fuel supply means for supplying fuel to be ignited;

ignition means for igniting fuel;

valve means for selectively permitting flow of said fuel;

a fuel nozzle for expelling fuel and being operatively associated with said valve means; and control means for preventing the combination of production of fuel flow and spark generation so as to prevent production of a flame and for permitting substantially simultaneous production of fuel flow and spark generation to produce a flame, wherein said control means includes:

a valve actuator which normally prevents escape of said fuel from said fuel supply when in a first position by preventing lifting of said fuel nozzle and is depressible to a second position which does not prevent lifting of said fuel nozzle;

a locking latch which is normally in a locked position preventing lifting of said fuel nozzle even if said valve actuator is depressed and which is movable laterally towards at least one of two opposite sides of said housing to an unlocked position which enables said fuel nozzle to be lifted upon depression of said valve actuator thereby causing fuel to flow; and elastomeric spring means for supplying a biasing force tending to lift said fuel nozzle, wherein selective application of a biasing force by the operator to said locking latch permits said locking latch to move from said locked position to said unlocked position.

34. The flame developing lighter according to claim 33 wherein the movement of said locking latch to said unlocked position is resiliently provided so as to automatically return said locking latch to its locked position when said valve actuator is released, thus preventing fuel flow.

35. The flame developing lighter according to claim 34 wherein lateral movement of said locking latch towards at least one of two opposite sides of said housing places said locking latch in said unlocked position.

36. The flame developing lighter according to claim 35 wherein said locking latch is resiliently maintained in said unlocked position by pressure exerted by said valve actuator on said locking latch.

37. The flame developing lighter according to claim 36 wherein said ignition means comprises a spark-producing wheel and a flint urged against said wheel and wherein sparks are produced by rotation of said wheel.

38. The flame developing lighter according to claim 36 wherein said ignition means comprises electric spark-producing means.

39. The flame developing lighter according to claim 36 wherein said ignition means comprises piezoelectric spark-producing means.

40. A flame producing lighter resistant to unauthorized use and normally maintained in a locked configuration comprising:

a housing;

fuel supply means for supplying fuel to be ignited;

a fuel nozzle for expelling said fuel;

elastomeric biasing means for applying a first biasing force biasing said fuel nozzle from a first position to a second position;

ignition means for igniting said fuel;

valve means for controlling the flow of said fuel, said valve means preventing fuel from flowing through said fuel nozzle when said fuel nozzle is in said first position and permitting fuel to flow through said fuel nozzle when said fuel nozzle is in said second position;

a valve actuator which normally prevents escape of said fuel when in a first position and is depressible to a second position which removes a second biasing force, said second biasing force tending to maintain said fuel nozzle in said first position; and a locking latch which is normally in a locked position and maintains said fuel nozzle in said first position even if said valve actuator is depressed, said locking latch being positionable into an unlocked position in which said locking latch permits actuation of said valve means by permitting movement of said fuel nozzle from said first position to said second position upon depression of said depressible valve actuator, wherein lateral movement of said locking latch towards at least one of two opposite sides of said housing places said locking latch in said unlocked position, said unlocked position being resiliently maintained by pressure exerted by said valve actuator on said locking latch.

41. The flame producing lighter according to claim 40 wherein said ignition means comprises a spark-producing wheel and a flint urged against said wheel and wherein sparks are produced by rotation of said wheel.

42. The flame producing lighter according to claim 40 wherein said ignition means comprises electric spark-producing means.

43. The flame producing lighter according to claim 40 wherein said ignition means comprises piezoelectric spark-producing means.

44. A flame producing lighter which comprises:

a housing defining reservoir for containing a combustible gaseous medium under pressure;

a fuel nozzle for expelling fuel;

valve means arranged for selective actuation between a normally closed position which prevents exit of said gaseous medium from said reservoir and in which said fuel nozzle is in a first position, and an open position which permits exit of gaseous medium from said reservoir through said valve means and in which said fuel nozzle is in a second position;

means for selectively producing sparks at a location proximate said fuel nozzle thereby selectively causing ignition of said gaseous medium;

means normally positioned for preventing actuation of said valve means to said open position by preventing movement of said nozzle from said first position to said second position, said valve actuation prevention means being movable out of said actuation prevention position only by application of an external user applied force;

means for selectively moving said valve actuation prevention means from said actuation prevention position to said open position whereby actuation of said valve means to the open position is permitted thereby selectively permitting exit of said combustible gaseous medium from said fuel nozzle and ignition of said gaseous medium by sparks produced by said spark producing means;

means for retaining said valve actuation prevention means in said valve actuation prevention position at least until said force is applied thereto; and, means for retaining said valve actuation prevention means in said open position at least until said valve means is actuated to the open position.

45. The flame producing lighter of claim 44 wherein said valve actuation prevention means is positioned around said fuel nozzle and is rotatable from said locked position to said unlocked position.

46. The flame producing lighter of claim 44 further comprising a biasing means for applying a biasing force biasing said fuel nozzle from said first position to said second position.

47. A flame producing lighter which comprises:

a housing defining reservoir for containing a combustible gaseous medium under pressure;

a fuel nozzle for expelling fuel;

valve means arranged for selective actuation between a normally closed position in which said fuel nozzle is in a first position preventing exit of said gaseous medium from said reservoir, and an open position in which said fuel nozzle is in a second position permitting exit of said gaseous medium from said reservoir through said valve means and said fuel nozzle;

means for selectively producing sparks at a location proximate said fuel nozzle thereby selectively causing ignition of said gaseous medium;

valve actuation prevention means movable between a first default position whereby actuation of said valve means to the open position is prevented, and an unlocked position whereby actuation of said valve means is permitted, said valve actuation prevention means being movable from said default position to said unlocked position only by application of an external user applied force; and means to retain said valve actuation prevention means in said unlocked position at least until said valve means is actuated to said open position.

48. The flame producing lighter of claim 47 wherein said valve actuation prevention means is positioned around said fuel nozzle and is rotatable from said default position to said unlocked position.

49. The flame producing lighter according to claim 47 further comprising valve actuator means for actuating said valve means.

50. The flame producing lighter of claim 49 further comprising a biasing means for applying a force biasing said fuel nozzle from said first position to said second position wherein said force supplied by said biasing means is less than a force supplied by said valve actuator means tending to keep said valve means in a closed position.

51. The flame producing lighter according to claim 47 wherein said valve means comprises a valve seal attached to an end of said fuel nozzle and a valve seat adapted for fuel flow therethrough and for engagement with said valve seal, said valve seal engaging said valve seat when said fuel nozzle means is in said first position thereby preventing fuel flow, and said valve seal not engaging said valve seat when said fuel nozzle means is in said second position.

52. A flame producing lighter which comprises:

a housing defining reservoir for containing a combustible gaseous medium under pressure;

valve means for controlling flow of said gaseous medium;

a fuel nozzle for expelling fuel and normally maintained in a first position and movable to a second position;

means pivotally mounted for selective actuation of said valve means between a normally closed position in which said fuel nozzle is in said first position preventing exit of said gaseous medium through said fuel nozzle, and an open position in which said fuel nozzle may enter said second position so as to permit exit of said gaseous medium from said reservoir through said fuel nozzle;

means for selectively producing sparks at a location proximate said fuel nozzle thereby selectively causing ignition of said gaseous medium; and means positioned around a portion of said fuel nozzle and configured, dimensioned and adapted, when in a locked position, for preventing movement of said fuel nozzle from said first position to said second position even if said valve actuation means is actuated to the open position, said prevention means being movable to an unlocked position in which depression of said valve actuation means moves said fuel nozzle from said first position to said second position thereby enabling fuel to flow, said prevention means returning automatically to said locked position after said valve means is moved to the open position and said valve actuation means released, said prevention means being movable from said locked position to said unlocked position only by the application of an external user applied force.

53. The flame producing lighter of claim 52 wherein movement of said prevention means from said locked position to said unlocked position is resiliently provided.

54. The flame producing lighter of claim 52 further comprising an elastomeric biasing means for applying a biasing force to said fuel nozzle tending to bias said fuel nozzle from said first position to said second position, said biasing force being sufficient to move said nozzle from said first position to said second position when said prevention means is in said unlocked position and said valve actuator means is depressed so as to be in said open position.

55. A flame developing lighter comprising:

a housing;

fuel supply means for supplying fuel to be ignited;

ignition means for igniting said fuel;

valve means for selectively permitting flow of said fuel proximate the ignition provided by said ignition means;

a fuel nozzle operatively associated with said valve means for expelling fuel and being movable between a first position preventing flow of fuel and a second position permitting flow of fuel;

a valve actuator which normally prevents escape of said fuel from said fuel supply means when in a first position and is depressible to a second position which permits actuation of said fuel supply means; and a locking latch normally positioned in a locked position preventing movement of said fuel nozzle from said first position to said second position thereby preventing flow of fuel even if said valve actuator is depressed, wherein selective application of a force by the operator to said locking latch moves said locking latch laterally out of said locked position and into an unlocked position in which depression of said valve actuator results in the flow of fuel.

56. The flame developing lighter according to claim 55 further comprising an elastomeric ring for biasing said fuel nozzle from said first position to said second position.

57. The flame developing lighter according to claim 55 wherein lateral movement of said locking latch towards at least one of two opposite sides of said housing moves said locking latch into said unlocked position.

58. A flame producing lighter which comprises:

a housing defining reservoir for containing a combustible gaseous medium under pressure;

valve means for controlling flow of said gaseous medium;

fuel nozzle means for expelling fuel and being operatively associated with said valve means;

actuator means pivotally arranged for selective actuation of said valve means between a normally closed position in which said fuel nozzle means is in a first position preventing exit of said gaseous medium from said reservoir, and an open position in which said fuel nozzle means is in a second position permitting exit of said gaseous medium from said reservoir through said valve means;

means for preventing movement of said fuel nozzle from said first position to said second position, said prevention means being selectively movable from a locked position in which said fuel nozzle means is prevented from moving from said first position to said second position even if said actuator means is depressed, to an unlocked position in which depression of said actuator means causes said fuel nozzle means to move from said first position to said second position thereby causing the flow of fuel through said fuel nozzle means, said prevention means being normally retained in said locked position, the movement thereof to said unlocked position being resiliently provided so as to automatically return said prevention means to its locked position and said nozzle means to its first position when said valve actuator is released, thus preventing said valve means from opening;

means for selectively producing sparks at a location proximate said fuel nozzle means thereby selectively causing ignition of said gaseous medium; and means for retaining said prevention means in said unlocked position at least until said actuator means is depressed.

59. The flame producing lighter of claim 58 further comprising elastomeric spring means for applying a biasing force to said fuel nozzle urging said fuel nozzle from said first position to said second position.

60. The flame producing lighter of claim 58 wherein said prevention means is selectively movable to any of a plurality of unlocked positions.

61. A fuel cut-off locking mechanism for use in combination with a lighter which comprises:

valve means for controlling flow of fuel from a fuel supply including a fuel nozzle which is normally in a first position preventing flow of fuel therethrough and being movable to a second position permitting flow of fuel therethrough, and a spring means for biasing said fuel nozzle from said first position to said second position;

means for selectively permitting actuation of said fuel supply including a depressible valve actuator which upon depression removes a force biasing said fuel nozzle to said first position; and a locking latch which is normally in a locked position preventing movement of said fuel nozzle from said first position to said second position even if said valve actuator is depressed, said locking latch being arranged such that lateral movement of said locking latch towards at least one of two opposite sides of said housing into an unlocked position permits, upon depression of said valve actuator, said spring means to move said fuel nozzle from said first position to said second position enabling fuel to flow, said locking latch being resiliently maintained in said unlocked position by force exerted by said valve actuator on said locking latch.

62. The fuel cut-off locking mechanism of claim 61 wherein said locking latch is laterally movable to any one of two unlocked positions.

* * * * *